United States Patent [19]

Marostica

[11] Patent Number: 5,003,636

[45] Date of Patent: Apr. 2, 1991

[54] NECKTIE DEVICE

[76] Inventor: Eugene J. Marostica, 221 Lyon St., Apt. #1906, Ottawa, Ontario, Canada

[21] Appl. No.: 484,930

[22] Filed: Feb. 26, 1990

[30] Foreign Application Priority Data

Jun. 6, 1989 [CA] Canada ..... 601942

[51] Int. Cl.[5] ..... A41D 25/00

[52] U.S. Cl. ..... 2/145; 2/155; 2/156

[58] Field of Search ..... 2/145, 150, 152 R, 153, 2/155, 156, 146

[56] References Cited

U.S. PATENT DOCUMENTS

| | | | |
|---|---|---|---|
| 1,227,053 | 5/1917 | Hoople | 2/155 X |
| 1,281,766 | 10/1918 | Climenson | 2/155 |
| 1,704,422 | 3/1929 | Belunes | 2/155 X |
| 1,712,209 | 5/1929 | Gumport | 2/155 X |
| 1,881,677 | 10/1932 | Klinetob | 2/155 X |
| 1,975,342 | 10/1934 | Zimmermann | 2/146 |
| 2,148,154 | 2/1939 | Garfinkle | 2/146 |
| 2,281,825 | 5/1942 | Burkholder | 2/155 |
| 3,872,513 | 3/1975 | Beaudin, Jr. et al. | 2/155 |
| 3,942,191 | 3/1976 | Hunnicutt | 2/145 |
| 4,958,383 | 9/1990 | Thompson | 2/150 |

FOREIGN PATENT DOCUMENTS

| | | | |
|---|---|---|---|
| 18504 | 4/1935 | Australia | 2/155 |
| 93062 | 12/1922 | Fed. Rep. of Germany | 2/155 |
| 546886 | 8/1942 | United Kingdom | 2/155 |

*Primary Examiner*—Werner H. Schroeder
*Assistant Examiner*—Jeanette E. Chapman
*Attorney, Agent, or Firm*—James Creighton Wray

[57] ABSTRACT

A necktie device for enabling the length of a necktie to be substantially correct for a respective wearer, when the necktie is transversely severed intermediate its end at two spaced-apart locations, the section therebetween removed, and the two enduring necktie sections connected to each other. The device includes a pair of tie supports adapted to be secured respectively to the necktie at said locations and thereafter to the severed ends of the two enduring necktie sections. Each tie support includes a first elongate part and a second elongate part to receive and secure the necktie therebetween, and there is also provided a connecting unit having a chamber on one side for receiving and securing one of the tie supports and a chamber on the other side for receiving and securing the other of the tie supports, the connecting unit being adapted to fit under the shirt collar of a wearer and to substantially conform therewith.

14 Claims, 4 Drawing Sheets

NECKTIE DEVICE

BACKGROUND OF THE INVENTION

1. Field of the Invention

This invention relates to a necktie device, it being understood that in use the said device constitutes an integral part of the necktie. The device is suitable for use with any ordinary necktie providing that the necktie is longer in length than is necessary to correctly fit a respective wearer.

2. Prior Art

In use, the ideal necktie should have the front tie strand fall to the waistband of the wearer, the rear tie strand slightly shorter than the front tie strand and the rear tie strand should be tucked in the holder on the back of the front tie strand. Unfortunately, neckties are usually manufactured in only one size so as to maintain manufacturing cost lower, etc. However there appears to be no consensus among manufacturers as to what the one size should be so that neckties from different manufacturers are often of different length. Furthermore different customers are of different body height and neck size and may prefer to knot a necktie in different ways whilst the tie material may be silk, cotton or some different material. All these factors can mean that, in use, the necktie will not hang properly with the front tie strand and the rear tie strand in the desired position in relation to the waistband of the wearer. Even if one of the tie ends is cut off to give the correct length for the respective wearer, that is not usually satisfactory as the cut end can rarely be finished to the quality and standard of the original manufactured end. In any event such a procedure could be costly and time consuming to an appreciable degree.

SUMMARY OF THE INVENTION

It is an object of the present invention to provide a necktie device to permit a necktie wearer to substantially overcome the above-identified difficulties.

According to the present invention there is provided a necktie device for enabling the length of a necktie to be substantially correct for a respective wearer, when said necktie is transversely severed intermediate its ends at two spaced-apart locations and the portion therebetween removed, said device comprising a pair of tie supports adapted to be secured respectively to the severed ends of said necktie, each of said tie supports comprising a first elongate part and a second elongate part to receive the associated severed end of said necktie therebetween, and a connecting unit having a chamber on one side for receiving and securing one of said tie supports and a chamber on the other side for receiving and securing the other of said tie supports, said connecting unit being adapted to fit under a shirt collar of said wearer and to substantially conform therewith.

These and further and other objects and features of the invention are apparent in the disclosure, which includes the above and ongoing written specification, including the claims and the drawings.

DETAILED DESCRIPTION OF THE INVENTION

Figure 1:
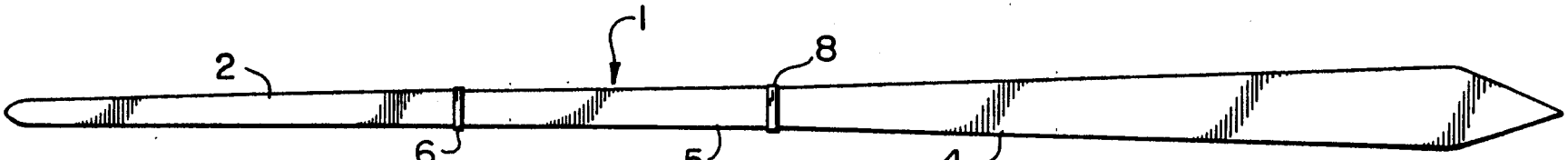
FIGS. 1 and 2 diagrammatically illustrate parts of a perspective view of a necktie device, according to one embodiment, in position for use with a necktie before it is severed and thereafter, FIGS. 3 and 4 diagrammatically illustrate the use of a pair of tie supports during the fitting of a necktie to a wearer, FIG. 5 diagrammatically illustrates an embodiment of a pair of tie supports located in relation to a necktie, FIG. 6 diagrammatically illustrates the underside of the arrangement of FIG. 5, FIG. 7 diagrammatically illustrates one of the tie supports in greater detail, FIG. 8 diagrammatically illustrates one of the tie supports with pair of tie guides attached, FIG. 9 diagrammatically illustrates one of the tie supports with a single tie guide attached.

The same reference numerals are used throughout for like parts.

Figure 2:
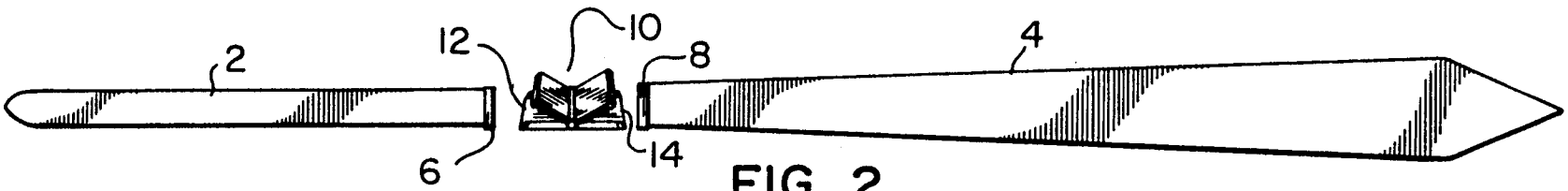

Referring now to FIGS. 1 and 2 there is shown one embodiment of the invention. FIG. 1 shows a necktie 1 comprising two enduring necktie sections 2 and 4 and excess tie material 5. A pair of tie supports 6 and 8 are secured respectively to the necktie 1 at two spaced-apart locations. In FIG. 2 the tie supports 6 and 8 are shown attached respectively to the severed ends of the two enduring necktie sections 2 and 4 after the excess tie material 5 is cut away and removed. A connecting unit 10 is also shown in position for receiving and securing the tie supports 6 and 8 in respective chambers 12 and 14 as will be explained below. The shape and size of the connecting unit is such that it can fit under the shirt collar of a wearer and substantially conform therewith.

Figure 3:
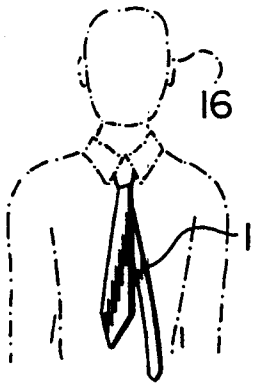
Figure 4:
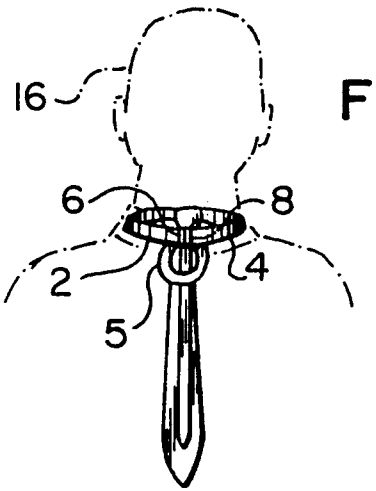

FIGS. 3 and 4 illustrate the use of a pair of tie supports 6 and 8 during the fitting of a necktie 1 to a wearer 16. In FIG. 3 the front tie strand of the necktie 1 is shown as falling to the desired length near the waistband of the wearer 16 whilst the rear tie strand falls incorrectly below the front tie strand. FIG. 4 illustrates the back view of the wearer 16 after the rear tie strand has been pulled up to the correct position so as to be slightly shorter than the front tie strand. As can be seen the tie supports 6 and 8 are secured respectively to the necktie 1 at two spaced-apart locations and are snapped to each other, as will be explained below, so that the two enduring necktie sections 2 and 4 can fit snugly around the neck of the wearer 16 beneath a shirt collar. The excess tie material 5 is shown actually hanging down from between the tie supports 6 and 8 and can be cut away after the tie supports are unsnapped from each other, as will be further explained below. The excess tie material 5 may be cut away whilst the necktie is still worn by a wearer, or conversely, after the necktie has been removed as shown in FIG. 1.

Figure 5:
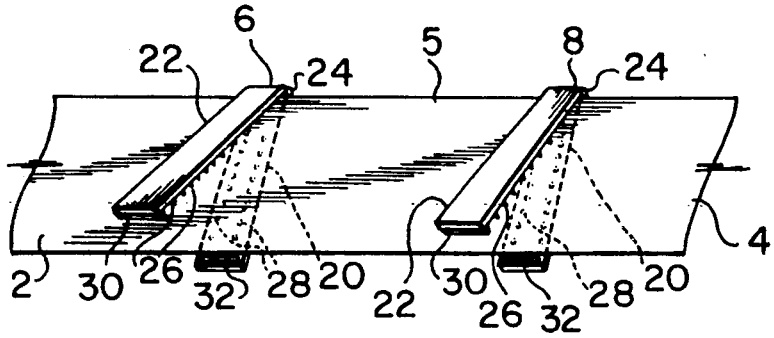

In FIG. 5 an embodiment of a pair of tie supports 6 and 8 is illustrated in relation to a necktie 1. A first rear part 20 lies between the necktie and the shirt collar of the wearer 16 (FIG. 4). A second front part 22 is hingedly connected to the first rear part 20 by hinge 24. As can be seen the necktie 1 lies between the first rear part 20 and the second front part 22. The front part 22 has one or more protruding fingers, sometimes called "tie pinchers" such as 26. The rear part 20 has finger-receiving receptacles such as 28. When the parts 20 and 22 are closed about hinge 24 the fingers 26 penetrate the necktie and engage in corresponding receptacles 28. A clip mechanism 30 and 32 is provided to secure the two parts 20 and 22 together. The clip mechanism comprises a bent over end 30 on front part 22 capable of snapping into a aperture 32 on rear part 20. If desired, in some arrangements, the parts 30 and 32 could instead be provided respectively on parts 20 and 22. When the tie support 6 and 8 are secured respectively to the necktie 1 at two spaced-apart locations the excess tie material 5 can be removed neatly by cutting along the inside edges of each tie support. After the excess tie material 5 is cut away and removed the tie supports 6 and 8 are found to be conveniently attached respectively to the severed ends of the two enduring necktie sections 2 and 4.

Figure 6:
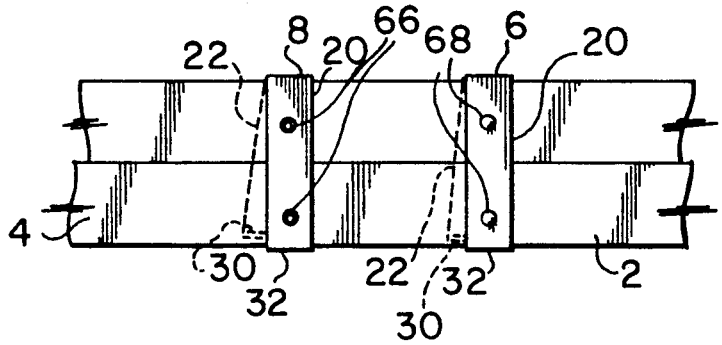

In FIG. 6 the underside of the arrangement of FIG. 5 is illustrated. One of the tie supports 6 is shown as having two snap fasteners 68 on the underside of rear part 20 whilst the other of the tie supports 8 is shown as having two cooperating snap fasteners 66 on the underside of rear part 20, said snap fasteners being of a type, for example rounded protrusions opposite rounded depressions, that the tie supports 6 and 8 can be positioned back to back and snapped together or pulled apart so as to test the fit of the two enduring necktie sections 2 and 4 before the excess tie material 5 is cut away and removed (FIG. 4).

Figure 7:
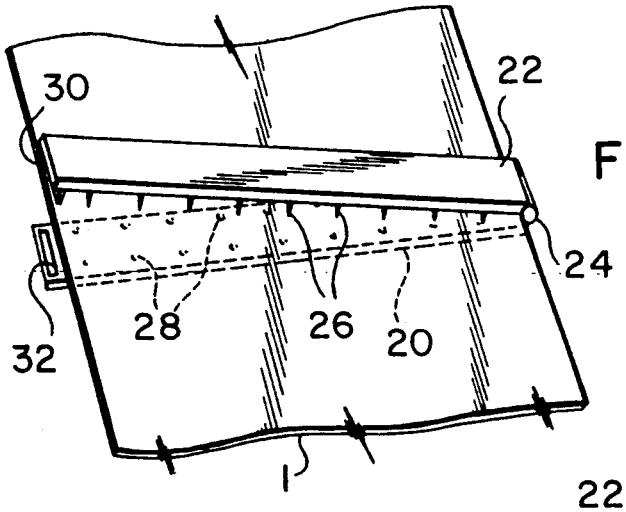

In FIG. 7 one of the tie supports 6 or 8 is shown in greater detail to better illustrate the main component parts, it being understood that a spring assembly could be provided with hinge 24 to assist in the opening or closing of parts 20 and 22. It will be further understood that parts 20 and 22 could be attached together at one end without hinge 24 so as to form a single bent part.

Figure 8:
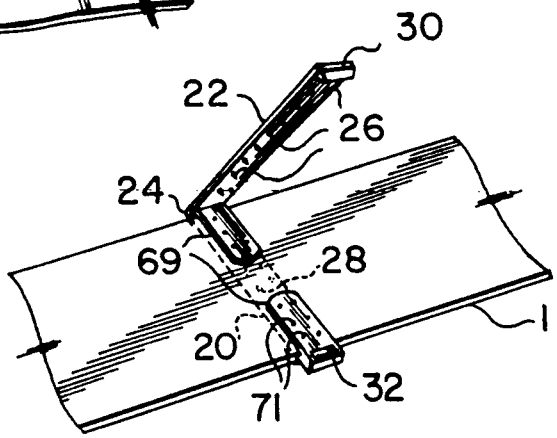

In FIG. 8 one of the tie supports 6 or 8 is illustrated with an optional pair of tie guides 69 attached respectively to the ends of rear part 20, the tie guides being designed to help position the tie support correctly onto a necktie. In use, the tie guides 69 are placed onto the necktie 1 as shown so that the tie support 6 or 8 can be moved along the length of the necktie 1 to a desired location where the front part 22 and the rear part 20 are closed together. The tie guides 69 have small openings 71 along their surface so as to permit protruding fingers 26 to pass through and penetrate the tie material and engage in corresponding receptacles 28. As can be seen the tie guides 69 do not interfere with the operation of the hinge 24 or the clip mechanism 30 and 32.

Figure 9:
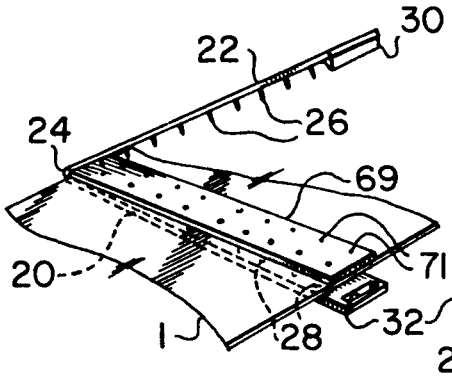

In FIG. 9 one of the tie supports 6 or 8 is illustrated with a single tie guide 69 attached to the hinged end of rear part 20. As shown the tie guide 69 conforms substantially in size and shape with the rear part 20 and does not interfere with the operation of the hinge 24 or the clip mechanism 30 and 32. If desired, in some arrangements, the tie guide 69 could be attached instead to the other end of rear part 20, it being understood, of course, that the tie guide 69 is an optional part of the tie support 6 or 8.

Figure 10:
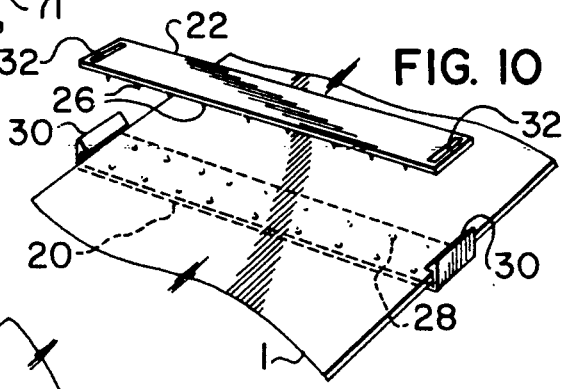
FIG. 10 is a diagrammatic representation of another embodiment of a tie support, FIGS. 11 and 12 diagrammatically illustrate another embodiment of a tie support, FIGS. 13 and 14 diagrammatically illustrate another embodiment of a tie support, FIGS. 15 and 16 diagrammatically illustrate another embodiment of a tie support.

In FIG. 10 a different embodiment of a tie support is illustrated comprising a separate rear part 20 and a separate front part 22. In use, the necktie 1 is placed between the two parts 20 and 22 as shown so that when the rear part 20 and the front part 22 are pressed together protruding fingers 26 penetrate the tie material and engage in corresponding receptacles 28. A clip mechanism 30 and 32 is provided at each end of the tie support to secure the two parts 20 and 22 to each other. The clip mechanism comprises a bent over end capable of snapping into an aperture 32.

Figure 11:
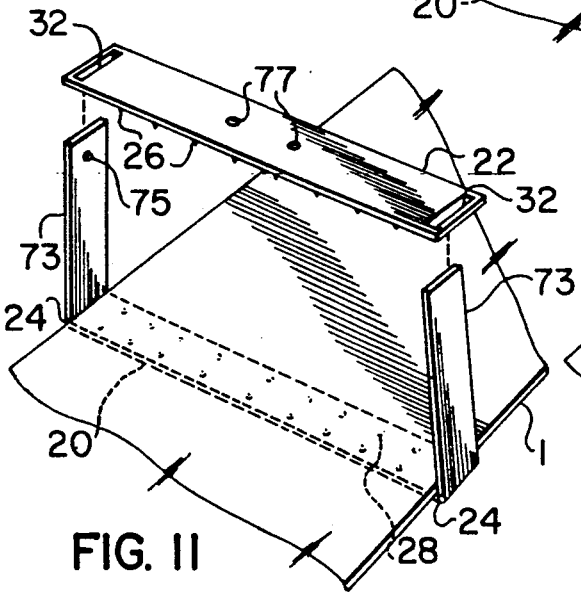
Figure 12:
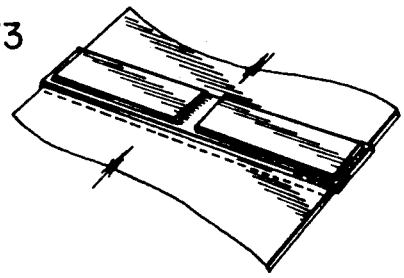

In FIGS. 11 and 12 a different embodiment of a tie support is illustrated comprising a separate rear part 20 and a separate front part 22. As can be seen a pair of prongs 73 are attached respectively to the ends of rear part 20 by hinge 24 and a pair of apertures 32 are located respectively at the ends of front part 22. In use, the necktie 1 is placed between the two parts 20 and 22 as shown so that when the rear part 20 and the front part 22 are pressed together the two prongs 73 engage the two apertures 32 whilst protruding fingers 26 penetrate the tie material and engage in corresponding receptacles 28. Snap fasteners 75 and corresponding cooperating snap fasteners 77 secure parts 20 and 22 together as shown, said fasteners being of a type, for example rounded protrusions opposite rounded depressions, that the two prongs 73 can be snapped onto the front part 22.

Figure 13:
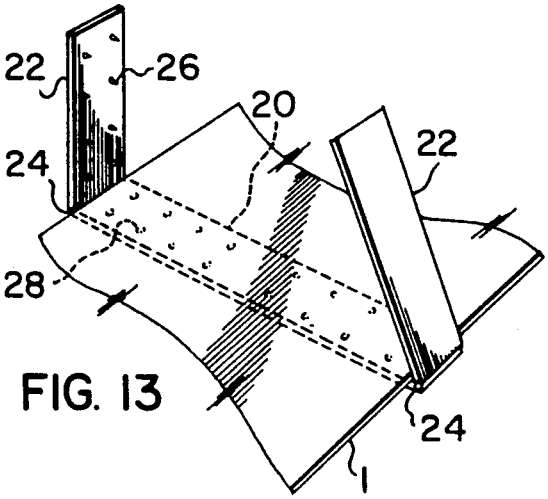
Figure 14:
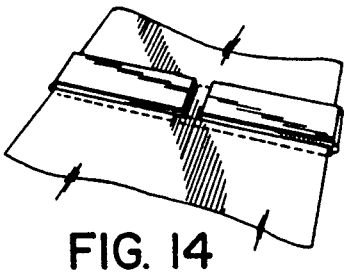

In FIGS. 13 and 14 a different embodiment of a tie support is illustrated comprising a pair of front parts 22 attached respectively to the ends of rear part 20 by hinge 24. In use, the necktie 1 is placed on rear part 20 as shown so that when the two front parts 20 are pressed towards the rear part 22 protruding fingers 26 penetrate the tie material and engage in corresponding receptacles 28 thereby securing the tie support onto the necktie.

Figure 15:
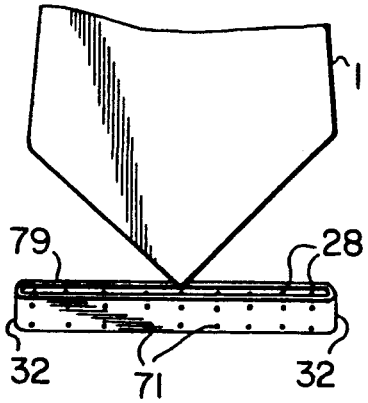
Figure 16:
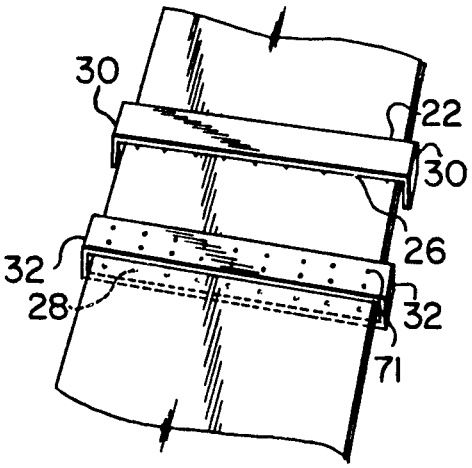

In FIGS. 15 and 16 a different embodiment of a tie support is illustrated comprising a separate hollow part 79 and a separate front part 22. In use, the hollow part 79 is placed onto the necktie 1 as shown and moved along the length of the necktie to a desired location where the front part 22 is pressed onto the hollow part 79 so that protruding fingers 26 pass through openings 71 and the tie material and engage in corresponding receptacles 28. There is also provided a clip mechanism 30 and 32 at each end of the tie support to secure parts 79 and 22 together. The clip mechanism comprises a bent over end 30 capable of snapping into an aperture 32. If desired, in some arrangements, the front part 22 could be attached to the hollow part 79 at one end with a hinge 24. Conversely, the front part 22 could be comprised of two parts, as shown in FIGS. 13 and 14, and attached respectively to the ends of hollow part 79.

Figure 17:
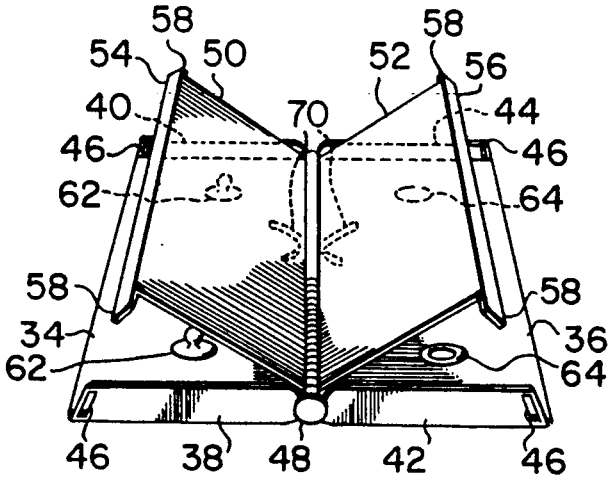
FIG. 17 is a diagrammatic representation of a connecting unit to show the details thereof, and FIGS. 18 and 19 diagrammatically illustrate another embodiment of a connecting unit.

In FIG. 17 the connecting unit is shown in greater detail. It will be seen to comprise two base plate members 34 and 36 having upstanding flanges 38, 40, 42, and 44 as shown. Apertures such as 46 are provided in each flange. The base plates 34 and 36 are pivotally connected together at a central spindle 48, flanges 38, 40, 42, and 44 being transverse to said spindle. Further plate members 50 and 52 are pivotally mounted on spindle 48 and can snap-fit inside the upstanding flanges 38, 40, or 42, 44. For this purpose each further plate member is bent over, or shaped, to provide an enlarged portion 54, 56 on its outside edge. The portions 54, 56 are provided with snap protrusions such as 58, on each side to snap into respective apertures 46 to lock the upper plate member 50 with the lower plate member 34 and the upper plate member 52 with the lower plate member 36. It will be understood that instead of actual apertures 46, depressions may be provided in the flanges.

If desired, in some arrangements, the portions 54, 56 could be provided with a push-spring on each side so that the snap protrusions, such as 58, may be pressed inward to engage or disengage, as appropriate, the apertures 46.

When closed, the members 34, 50 and 36, 52 form chambers to receive a respective tie support 6 or 8 (FIG. 1). The members 34 and 36 each have a pair of snap fasteners 62 and 64 formed in them whilst corresponding cooperating snap fasteners 66 and 68 (FIG. 6) are formed in the tie supports so that the tie supports 6 and 8 are held in a secure manner in the connecting unit 10. The respective plate members, of course, are attached to the spindle 48 so that, in use, the connecting unit can adjust so as to conform to the contour of the neck of the wearer.

As shown in FIG. 17 a spring assembly 70 is provided with plate members 34 or 50 and 36 or 52 to assist in the opening and closing of the members of the connecting unit. However, it will be understood that in some units the spring assembly may be omitted.

Figure 18:
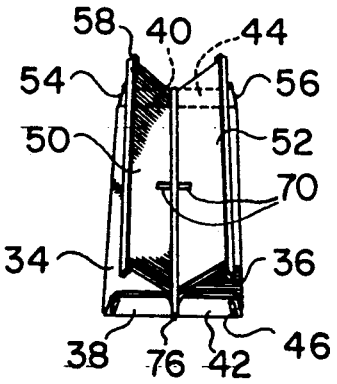
Figure 19:
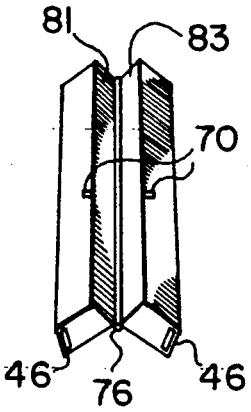

In FIGS. 18 and 19 an alternative construction of a connecting unit is illustrated comprising two base plate members 34 and 36 having upstanding flanges 38, 40, 42, 44, 81 and 83 as shown. Instead of a spindle 48 of the embodiment shown in FIG. 17, the base plate members 32 and 34 are joined together with a hinge assembly 76. Further plate members 50 and 52 are pivotally connected to respective flanges 38, 40 and 42, 44 as shown. It will be understood that base plate members 34 and 36 could be joined together without the hinge assembly 76 so as to form a single base plate member, with or without upstanding flanges 81 and 83.

The chambers enclosed by the plate members are, of course, designed to accommodate the tie supports which correspond in length to the width of the part of a necktie under a shirt collar and so that a convenient clip in - clip out fit is achieved.

As will be appreciated the necktie device may be made of any suitable material, for example metal or plastic.

It will be readily apparent to a person skilled in the art that a number of variations and modifications can be made without departing from the true spirit of the invention which will now be pointed out in the appended claims.

I claim:

1. A necktie device for enabling the length of a necktie to be substantially correct for a respective wearer, when said necktie is transversely severed intermediate its ends at two spaced-apart locations and the portion therebetween removed, said device comprising:

(a) a pair of tie supports adapted to be secured respectively to the severed ends of said necktie, each of said tie supports having a first elongate part and a second elongate part to receive the associated severed end of said necktie therebetween, and (b) a connecting unit having a chamber on one side for receiving and securing one of said tie supports and a chamber on the other side for receiving and securing the other of said tie supports, said connecting unit being adapted to fit under a shirt collar of said wearer and to substantially conform therewith.

2. A necktie device according to claim 1 wherein:

(a) said first and second elongate parts are hingedly connected together at one end, (b) said first elongate part having one or more protruding fingers for extending into said necktie, (c) said second elongate part having corresponding finger receiving receptacles whereby when said parts are closed over the severed end of a necktie the two parts are clamped thereon.

3. A necktie device according to claim 1 wherein:

(a) said first and second elongate parts are separate parts when not in use, (b) a clip mechanism provided at least at one end of said first and second elongate parts to secure the said parts together when in use, (c) said first elongate part having one or more protruding fingers for extending into said necktie, (d) said second elongate part having corresponding finger receiving receptacles whereby when said parts are in use over the severed end of a necktie the two parts are clamped thereon.

4. A necktie device according to claim 1, wherein each tie support has one or more snap fastener parts to permit fastening of the pair of tie supports together and to permit fastening in a said respective chamber when in use with a tie.

5. A necktie device according to claim 1 wherein (a) said connecting unit comprises a first and a second pair of plate members pivotally connected together on a spindle, (b) each pair of plate members comprising a first plate member having an upstanding flange along an edge parallel to said spindle and a second plate member having an upstanding flange along each edge transverse to said spindle, (c) each flange of a first plate member having a protruding snap portion to cooperate with a snap portion on the corresponding flange of a corresponding second plate member, whereby in use each of said first and second plate members are held together to form a respective chamber.

6. A necktie device according to claim 2 wherein (a) said connecting unit comprises a first and a second pair of plate members pivotally connected together on a spindle, (b) each pair of plate members comprising a first plate member having an upstanding flange along an edge parallel to said spindle and a second plate member having an upstanding flange along each edge transverse to said spindle, (c) each flange of a first plate member having a protruding snap portion to cooperate with a portion on the corresponding flange of a corresponding second plate member, whereby in use each of said first and second plate members are held together to form a respective chamber.

7. A necktie device according to claim 3 wherein (a) said connecting unit comprises a first and a second pair of plate members pivotally connected together on a spindle, (b) each pair of plate members comprising a first plate member having an upstanding flange along an edge parallel verse to said spindle and a second plate member having an upstanding flange along each edge transverse to said spindle, (c) each flange of a first plate member having a protruding snap portion to cooperate with a snap portion on the corresponding flange of a corresponding second plate member, whereby in use each of said first and second plate members are held together to form a respective said chamber.

8. A necktie device according to claim 5, wherein said spindle is provided with a spring assembly to assist in the opening and closing of each pair of plate members to form said respective chamber.

9. A necktie device according to claim 5, wherein each first plate member has one or more snap fastener parts to each cooperate with a corresponding respective snap fastener part on a respective tie support.

10. In combination a tie severed into two parts and a necktie device comprising:

(a) a pair of tie supports adapted to be secured respectively to the severed ends of said necktie, each of said tie supports having a first elongate part and a second elongate part to receive the associated severed end of said necktie therebetween, and (b) a connecting unit having a chamber on one side for receiving and securing one of said tie supports and a chamber on the other side for receiving and securing the other of said tie supports, said connecting unit being adapted to fit under a shirt collar of said wearer and to substantially conform therewith.

11. A necktie device according to claim 6, wherein said spindle is provided with a spring assembly to assist in the opening and closing of each pair of plate members to form a respective chamber.

12. A necktie device according to claim 7, wherein said spindle is provided with a spring assembly to assist in the opening and closing of each pair of plate members to form a respective chamber.

13. A necktie device according to claim 6, wherein each first plate member has one or more snap fastener parts to each cooperate with a corresponding respective snap fastener part on a respective tie support.

14. A necktie device according to claim 7, wherein each first plate member has one or more snap fastener parts to each cooperate with a corresponding respective snap fastener part on a respective tie support.

* * * * *